US011696369B2

(12) United States Patent
Torrico et al.

(10) Patent No.: US 11,696,369 B2
(45) Date of Patent: Jul. 4, 2023

(54) PROCESS OF MAKING CONFORMABLE, LOW VOLTAGE, LIGHT WEIGHT JOULE HEATING ELEMENTS

(71) Applicant: University of Cincinnati, Cincinnati, OH (US)

(72) Inventors: Noe Alvarez Torrico, Cincinnati, OH (US); Ryan Noga, Cincinnati, OH (US); Seyram Gbordzoe, Cincinnati, OH (US); Vesselin N. Shanov, Cincinnati, OH (US)

(73) Assignee: University of Cincinnati, Cincinnati, OH (US)

( * ) Notice: Subject to any disclaimer, the term of this patent is extended or adjusted under 35 U.S.C. 154(b) by 489 days.

(21) Appl. No.: 16/611,288

(22) PCT Filed: May 9, 2018

(86) PCT No.: PCT/US2018/031828
§ 371 (c)(1),
(2) Date: Nov. 6, 2019

(87) PCT Pub. No.: WO2018/208935
PCT Pub. Date: Nov. 15, 2018

(65) Prior Publication Data

US 2020/0107408 A1 Apr. 2, 2020

Related U.S. Application Data

(60) Provisional application No. 62/503,517, filed on May 9, 2017.

(51) Int. Cl.
*H05B 3/14* (2006.01)
*H05B 3/00* (2006.01)
(Continued)

(52) U.S. Cl.
CPC ..... *H05B 3/145* (2013.01); *H05B 3/0014* (2013.01); *H05B 3/342* (2013.01); *H05B 3/36* (2013.01); *H05B 2214/04* (2013.01)

(58) Field of Classification Search
CPC ..... H05B 3/145; H05B 3/0014; H05B 3/342; H05B 3/36; H05B 3/34; H05B 3/286; H05B 2214/04
See application file for complete search history.

(56) References Cited

U.S. PATENT DOCUMENTS 9,796,121 B2 10/2017 Shanov et al.
2007/0295714 A1* 12/2007 Liu ..... H05B 3/34 219/553

(Continued)

OTHER PUBLICATIONS

International Search Report and Written Opinion in International Patent Application No. PCT/US2018/031828, dated Aug. 21, 2018, 13 pgs.

*Primary Examiner* — Shawntina T Fuqua
(74) *Attorney, Agent, or Firm* — Wood Herron & Evans LLP

(57) ABSTRACT

Disclosed are methods of making low voltage joule heating elements (10, 40, 50) from carbon nanotubes (CNT) (32). In an embodiment, the heating element (10) includes layers (12) of aligned thin film CNTs. In another embodiment, the heating element (40) includes CNTs (32) dispersed in a polymer (34) to form a CNT polymer composite (30). In another embodiment, the heating element (50) includes CNT thread (52) stitched to a fabric (54). Each embodiment further includes a pair of electrodes (20, 22, 42, 44, 56, 58) that are configured to be couple to a source of electricity. Embodiments further include an encapsulating film (24, 46) over at least the heating element. The heating elements (10, 40, 50) produced by the processes disclosed herein are lightweight and highly efficient and suitable for many uses (Continued)

including incorporation into objects such as clothing and footwear.

56 Claims, 3 Drawing Sheets

(51) Int. Cl.
*H05B 3/34* (2006.01)
*H05B 3/36* (2006.01)

(56) References Cited

U.S. PATENT DOCUMENTS

| | | | | |
|---|---|---|---|---|
| 2009/0314765 | A1 | 12/2009 | Feng et al. | |
| 2010/0122980 | A1 | 5/2010 | Wang et al. | |
| 2010/0237055 | A1* | 9/2010 | Rousseau | B32B 17/10743 156/99 |
| 2011/0108545 | A1* | 5/2011 | Wang | H05B 3/286 219/546 |
| 2013/0316172 | A1 | 11/2013 | Shanov et al. | |
| 2014/0103009 | A1* | 4/2014 | Feng | H05B 3/145 216/20 |
| 2015/0137414 | A1 | 5/2015 | Shanov et al. | |
| 2017/0291580 | A1* | 10/2017 | Loganathan | H05B 3/84 |
| 2018/0118875 | A1* | 5/2018 | Leenders | B29C 65/4815 |
| 2021/0071917 | A1* | 3/2021 | Pei | H10N 15/15 |
| 2022/0315733 | A1* | 10/2022 | Kumar | C08L 25/02 |
| 2022/0389186 | A1* | 12/2022 | Araya Hermosilla | C08K 3/04 |

* cited by examiner

PROCESS OF MAKING CONFORMABLE, LOW VOLTAGE, LIGHT WEIGHT JOULE HEATING ELEMENTS

STATEMENT REGARDING FEDERALLY SPONSORED RESEARCH OR DEVELOPMENT

This invention was made with government support under T42 OH008432 awarded by Center for Disease Control. The government has certain rights in the invention.

TECHNICAL FIELD

The present invention relates generally to joule, also known as ohmic or resistive, heating elements and methods herein describe manufacturing processes of conformable, low voltage, low mass joule heating material and heating devices from carbon nanotubes.

BACKGROUND

The development of joule heating elements is a multibillion-dollar market worldwide. Medical and aerospace flexible heaters alone are a $3.3 billion industry with a compound annual grow rate of 6%. Most of these flexible heaters rely on metal alloy heaters like Kanthal™, Nichrome™, and Cupronickel™ that have the capability to withstand high temperatures without oxidation. These metal-based resistive heaters typically operate on higher voltages than those of handheld devices, USB ports, and batteries, especially when supplying higher temperature heating demands. Joule heating devices are by nature dependent on electrical energy, and so energy efficient heaters are of high value. The growing consumer market for battery-powered electronics, including incorporation into textiles and clothing, is ideally suited for efficient new heaters that deliver greater temperature ranges than traditional resistive metal heating wires on these lower available voltage potentials.

A need exists for electric heaters that can provide sufficient heating in applications where high voltage potentials are not available.

SUMMARY

In its broadest aspects, the present invention is directed to conformable, flexible, low mass carbon nanotube-based joule heating elements and methods of making these heating elements. Three forms of joule heating elements are described: aligned carbon nanotube thin film-based joule heating elements, dispersed carbon nanotube composite based joule heating elements, and stitched carbon nanotube based joule heating elements. The aligned carbon nanotube thin film-based joule heating elements includes layers of aligned thin film CNTs. The dispersed carbon nanotube composite based joule heating element includes CNTs dispersed in a polymer to form a CNT polymer composite. The CNT polymer composite is then formed to the shape and thickness for desired end use. The stitched carbon nanotube based joule heating element includes CNT thread stitched to a fabric. Each embodiment further includes a pair of electrodes that are configured to be couple to a source of electricity. Embodiments further include an encapsulating film over at least the heating element.

The heating elements produced by the processes disclosed herein are lightweight and highly efficient and suitable for many uses including incorporation into objects such as clothing and footwear.

DETAILED DESCRIPTION

Figure 1:
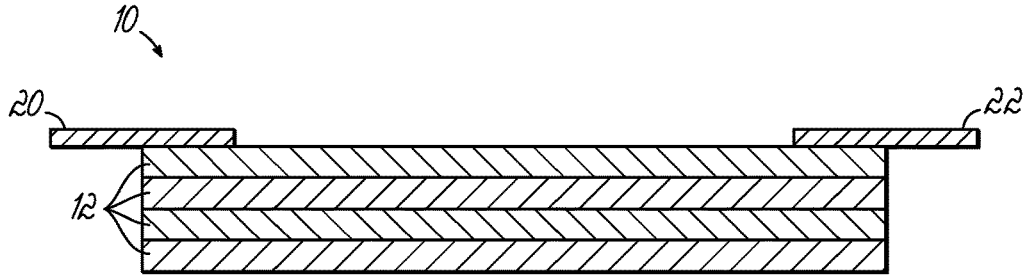
FIG. 1 is an illustration of a cross-sectional view of an aligned carbon nanotube thin film joule heating element according to an embodiment of the present invention.

Embodiments of the present invention are directed to conformable, flexible, low mass carbon nanotube-based joule heating elements. More specifically, embodiments of the present invention are directed to three forms of joule heating elements: aligned carbon nanotube thin film-based joule heating elements, dispersed carbon nanotube composite based joule heating elements, and stitched carbon nanotube based joule heating elements. All three types of joule heating elements have unique properties specific to that technology that can be adjusted and optimized depending on the intended application. All three CNT based joule heating elements may provide sufficient when operating on electric potentials under 25 V. The electrical conductivity and heating performance of the CNT based joule heating elements increases as the internal temperature rises, allowing very fast response times suited for rapid and/or high-temperature heating applications.

Carbon nanotubes may be grown by a variety of techniques, such as oriented synthesis and bulk synthesis. In oriented synthesis, CNTs are grown in the form of an aligned array on a substrate. The array contains many CNTs grown in the same orientation. Carbon nanotubes are usually categorized according to the number of walls that the carbon nanotube has, and there are a variety of CNT morphologies. For example, there are multi-walled carbon nanotubes (MWCNT), double-walled carbon nanotubes (DWCNT), and single-walled carbon nanotubes (SWCNT). As used herein, the term carbon nanotubes refer generally to any of these morphologies, unless otherwise stated. Suitable methods of growing a CNT array are described in U.S. Patent Application Publication Nos. 2013/0316172 and 2015/0137414, the disclosures of which are incorporated herein in their entireties.

Carbon nanotubes have extraordinary electrical and thermal properties, and when assembled into macroscopic structures, they may provide impressive performance as a low voltage joule heating material. Both the aligned film-based and dispersed composite-based CNT joule heating elements are versatile by nature and are well suited for custom and/or specialty applications, especially those requiring heat yet have unfavorable conditions for metals such as copper and Nichrome™. CNTs are excellent thermal conductors and have large surface areas that facilitate a rapid heat transfer process. Weight-normalized heating performance analyses of CNTs demonstrate its superior properties for such a lightweight material. The simplicity of the fabrication process and the variety of dimensions achievable through bottom-up assembly processes makes CNT an attractive substitute for metals and metal alloys for electric joule heaters. Applications for these joule heating elements include uses where fast and flexible heating is needed but high voltage potentials are not available. Some initial examples include portable electronics, smart clothing, electric vehicles, aerospace, air ship and high altitude balloons, precision analysis or processing instruments, and medical applications such as patient comfort, dialysis systems, fluid warming, and humidity control.

Heaters including CNT joule heating elements according to embodiments of the present invention are conformable. In that regard, such heaters may be directly applied to, for example, moving parts or textiles and show no performance degradation due to mechanical fatigue from repetitive movement or bending. Maximizing surface contact has the direct effect of maximizing heat transport for a more uniform and responsive heating performance. The conformability allows for a faster and more precise shaping process then needed for traditional metal wire resistive heaters. Thicknesses may also be tailored much easier and to a greater degree of precision at the point and time of application by simply controlling the amount, thickness, and/or location of CNT material applied. In contrast, the diameters of commercial resistive heating wire are fixed during manufacture of raw materials, and these metals would need to be welded, melted, or held by a thermally conductive epoxy to adhere to the substrate.

Additionally, CNT joule heating elements according to embodiments of the present invention may have a significantly lower mass compared to traditional metal heaters. A low mass is important for heaters used in clothing, aerospace, and medical applications.

Figure 2:
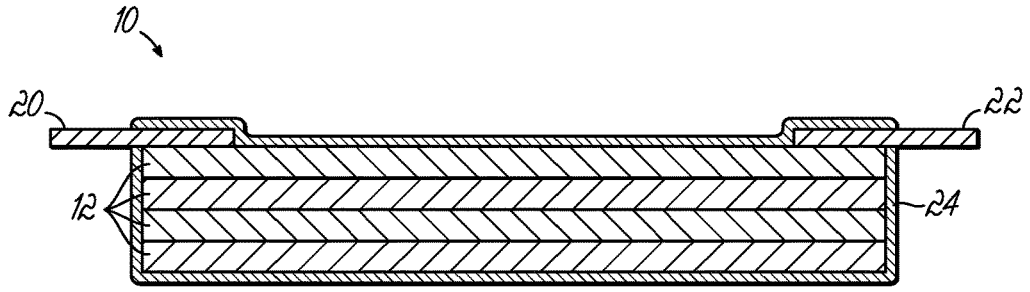
FIG. 2 is an illustration of a cross-sectional view of an aligned carbon nanotube thin film joule heating element include an encapsulating polymer according to an embodiment of the present invention.

With reference to FIGS. 1 and 2, which are not drawn to scale, embodiments of an aligned thin film CNT joule heating element 10 are provided. An aligned thin film CNT joule heating element 10 is made from CNTs that have the ability to self-assemble into aligned films and sheets (e.g., a spinnable CNT array) that may be layered to form the heating element 10. The aligned thin film CNT joule heating element 10 may include one layer 12 or more than one layer of CNTs. For example, the number of CNT layers 12 may be on the order of two to several hundred layers and 1000 layers or more. In an embodiment, the number of CNT layers is between 2 layers and 500 layers, or between 2 layers and 100 layers, or between 10 layers and 100 layers. As the number of layers increases, the resistance of the device decreases. If the number of layers is too great, resistance in the device will drop to a point that too much power will be required to reach the target temperature. In an embodiment, the upper number of layers is 100 layers.

Embodiments of the thin film CNT joule heating element 10 may be fabricated via drawing CNTs from a spinnable CNT array and assembling a thin, aligned CNT film. In an embodiment, the spinnable CNT array may be drawn onto a mandrel. To form an aligned thin film CNT joule heating element 10 including more than one CNT layer 12, the CNTs are wrapped around the mandrel, and the wrapped CNTs may be cut to remove the layered film. The rate of drawing the CNTs may vary between 0 and 50 m/s, and may be effectively drawn commercially at, for example, 16 m/s. The thickness of embodiments of the thin films may be between 0.04 and 1000 μm.

Embodiments of the CNT based joule heating element 10 may be integrated in a piece of clothing, such as a glove, jacket, or shoe/boot insole. The heated clothing item can be powered by a source of electricity, such as a battery like a 9 V battery. Further applications of CNT based joule heating elements 10 include radiant heaters beneath paint and surface de-icing of metal and plastic surfaces as well as other uses discussed herein with respect to other embodiments.

CNTs useful in embodiments of the invention are stable at 400° C. and an CNT joule heating element 10, 40, 50 made from them may have the capacity to reach very high temperatures, in the range of 100° C. to 400° C. (212° F. to 572° F.), in less than 60 sec and, in some embodiments, less than 10 sec. CNTs may also have diameter to length ratios ranging from 1:1,000 to 1:1,000,000,000 and densities of less than 1 g/cc, or a density in a range from 0.1 g/cc to 3 g/cc, which is almost ⅛ that of copper. This combination of large surface area and low mass of the CNT allows the CNT joule heating elements 10, 40, 50 made therefrom them to rapidly heat and cool during use, making them ideal resistive heating materials for responsive electric heaters.

CNTs useful in embodiments of the invention are excellent electrical conductors, which allows them to serve as ideal coating for heating purposes. By controlling the thickness of the aligned film, the electrical resistance of the final heating element may also be controlled. The electrical resistance of the aligned thin film CNT joule heating element 10 is dependent at least in part on the number of layers 12. The electrical resistance can range from, for example, 3.57 kΩ/sq for a single layer to 6.03 Ω/sq for 300 layers. These films are extremely thin compared to their metal-based counterparts. The thickness of the thin film may range from, for example, 0.05 to 15 μm. For example, a 10-layer CNT film is only 0.5 μm thick and a 100-layer CNT film is only 5 μm thick. Embodiments of the invention include CNT film having a thickness from 0.1 μm to 10 μm, or from 0.5 μm to 5 μm, or from 0.5 μm to 1 μm. Despite their submicron thicknesses, they still maintain strength and durability from the CNTs, which do not fail from cyclic mechanical fatigue as most metals do.

As discussed in greater detail below, embodiments of an aligned thin film CNT joule heating element 10 may be encapsulated in a polymer film 24, such as an insulating polymer like between films of high temperature polyamides like Kapton™, which can function as an insulator, as well as, in some embodiments, protect the heating element from exposure to environmental conditions, such as water or sweat.

Figure 3:
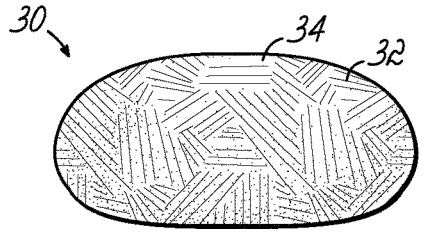
FIG. 3 is an illustration of a dispersed CNT composite.
Figure 4:
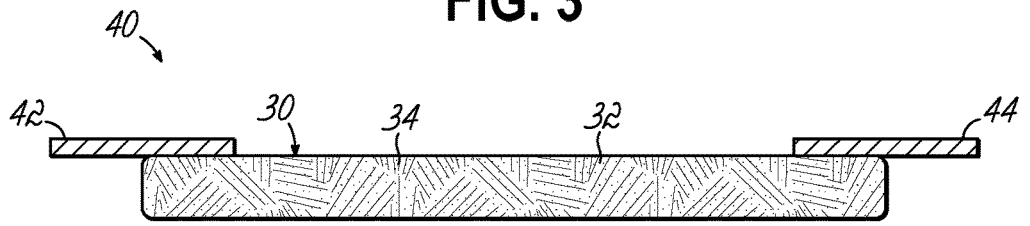
FIG. 4 is an illustration of a cross-sectional view of a dispersed CNT joule heating element according to an embodiment of the present invention.
Figure 5:
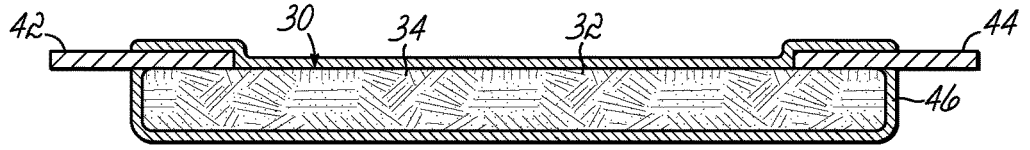
FIG. 5 is an illustration of a cross-sectional view of a dispersed CNT joule heating element include an encapsulating polymer according to an embodiment of the present invention.
Figure 6:
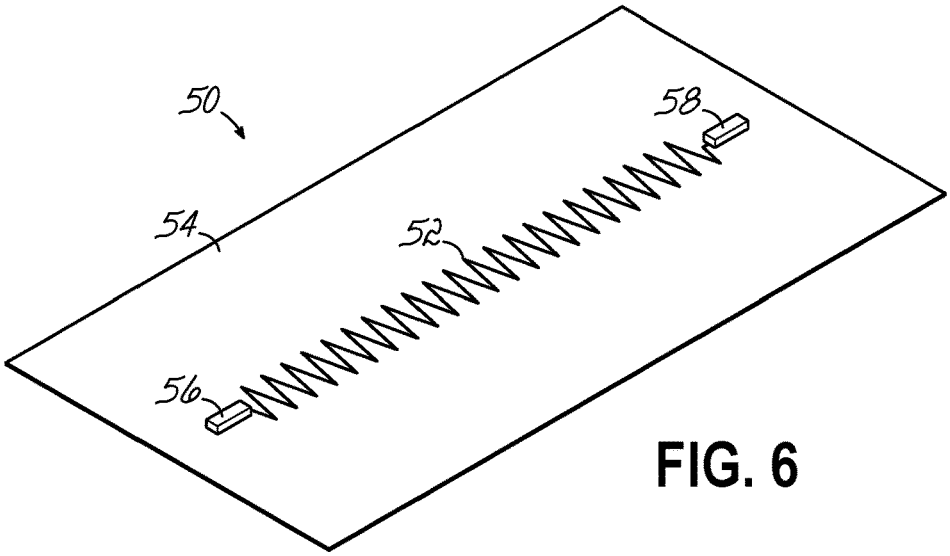
FIG. 6 is an illustration of a perspective view of a stitched CNT thread joule heating element according to an embodiment of the present invention.
Figure 7:
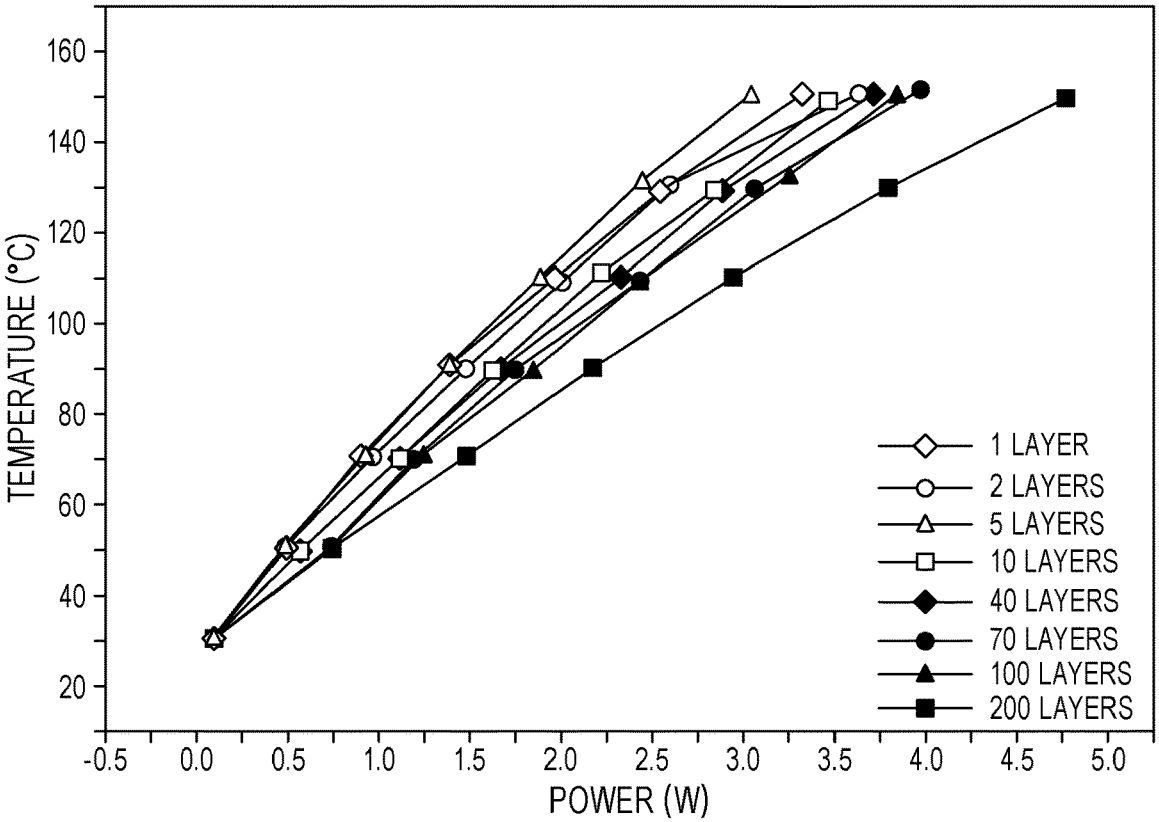
FIG. 7 is a graph of heating temperature curves of multiple aligned CNT thin film heaters according to various embodiments of the present invention as a function of the consumed power.

With reference to FIGS. 3-5, embodiments of a dispersed CNT polymer composite 30 are formed into a dispersed CNT polymer composite joule heating element 40 are provided. The CNT polymer composite 30 may include CNTs 32 dispersed within a polymer 34, such as thermoplastic polymer like polyurethane (TPU), polystyrene, polyvinyl chloride (PVC), fluorinated polymers, hydrogenated butadiene rubber, polyethylene, polystyrene, polypropylene, polytetrafluoroethylene, polyimides and polyamides. The CNTs 32 may be spinnable or non-spinnable CNTs, of single-walled (SWCNT), double-walled (DWCNT), multi-walled (MWCNT) character, or combinations thereof. The CNTs 32 may have different diameters, lengths, or chiralities, for example, from a semi-conducting zigzag chirality to a metallic armchair chirality and can consist of any combination thereof. The CNT 32 may or may not still contain trace catalyst remnants, such as iron or nickel. The CNT 32 may or may not contain additional carbon species, such as amorphous carbon or carbon black.

Embodiments utilize a non-volatile organic solvent concurrently able to dissolve the chosen polymer 34 and able to be effective in dispersing CNT 32, such as N-Methyl-2-pyrrolidone (NMP), acetone, alcohols, tetrahydrofuran (THF), dichloromethane, and organics that bring CNTs in solutions to facilitate mixing between the CNT 32 and polymer 34.

In an embodiment, the polymer 34 may first be dissolved in the solvent, using mechanical mixing while heating to a temperature in a range from 50° C. to 300° C. The CNTs 32 may be dispersed in the mixture, also with mixing and heating to a temperature in a range from 50° C. to 300° C. Mixing may be aided by the use of an ultra-sonicator or homogenizer, with the objective to achieve a more uniform dispersion of the CNTs 32 within the polymer 34 solution. The consistency and viscosity of the composite 30 may be adjusted by adding or removing an appropriate amount of solvent. In another embodiment, the CNT polymer composite 30 may be formed through controlled polymerization of the appropriate chemical monomer precursors, of which one of the precursors, such as ethylene glycol and precursor of polyurethane (TPU), polystyrene, polyvinyl chloride (PVC), fluorinated polymers, hydrogenated butadiene rubber, polyethylene, polystyrene, polypropylene, polytetrafluoroethylene, polyimides and polyamides, contains a prepared dispersion of CNT 32 therein.

In an embodiment to further process the CNT composite 30 once the CNTs are sufficiently dispersed with the polymer 34 solution, a significant portion of the solvent may be removed to create a conformable, malleable, dough-like putty consistency optimized for ease of storage, transportation, and handling when shaping the joule heating element FIG. 3. Removing non-volatile organic solvent may be carried out using a polar liquid that is completely miscible with the non-volatile organic solvent. For example, a suitable solvent is N-Methyl-2-pyrrolidone (NMP), and a suitable polar liquid completely miscible with NMP is water. If the solvent is completely miscible with water and the polymer 34 and CNTs 32 are not, the polymer 34 and CNT 32 dispersed therein will precipitate from the solution upon contact, achieving physical separation. Prior to the removal of the solvent, a CNT composite 30 may include, for example, 40%-90% solvent, 10%-40% polymer 34, and 0.001%-20% CNTs 32 by weight or, for example, 65%-90% solvent, 5%-20% polymer 34, and 0.001%-5% CNTs 32 by weight. After the solvent is removed, the remaining polymer-CNT composite heater 40 may have a 0.01%-20% CNT content by weight and able to draw large currents from low voltage potentials for heating, as compared to commercial metal resistive heating wires.

The components in the dispersed CNT polymer composite 30 may vary in their response and tolerances to temperature exposure, duration of exposure, and degree. For example, CNT thermal stabilities can differ as a result of their radius, length, number of walls, and surrounding conditions but can typically be reliably used up to temperatures near and exceeding 400° C. Suitable polymers, such as thermoplastic polyurethanes, will melt between 200° C. and 230° C. and begin to degrade under prolonged exposures to temperatures exceeding 250° C. For these reasons, the CNT polymer composite heaters 40 can be used within three different tiers of temperature ranges: tier 1, 25° C.-200° C.; tier 2, 200° C.-300° C.; and tier 3, 300° C.-550° C. The designation of tier depends on the level of degradation of the dispersed CNT heating composite material the specific application permits. When structural integrity of the heater is important, tier 1 heating at 25° C.-200° C. may be used for applications that can tolerate little to no thermal degradation. Tier 1 is suitable for longer run times of consistent heating as well as when reusability and reliability is needed. Tier 2 heating at 200° C.-300° C. services the slightly more disposable and temporary applications where some thermal degradation and/or deformation is acceptable due to the short-term life expectancy of the heater. Tier 2 is suitable for applications when heating is applied for short durations, a few minutes or less such as up to 5 minutes or up to 3 minutes or up to 2 minutes or up to 1 minute and is only relied on for a limited number of uses such as up to 10 uses or up to 5 uses or up to 3 uses. Tier 3 heating at 300° C.-550° C. is intended for applications requiring a single use as a sacrificial high-temperature heating source. Tier 3 is suitable for applications that need a short burst of intense heat but the heater, and perhaps the entire heating surface, is not expected to remain functional or intact. This may or may not serve an intended function or trigger other series of chronological events that lead to an intended outcome, such as a chemical reaction or a thermal fuse. Embodiments of the dispersed CNT composite heaters 40 may also be operated while submerged in a liquid such as water or ethanol.

The dispersed CNT polymer composite 30 is capable of adapting to the geometry of the supporting surface or object to be heated. This composite may have a consistency that can be shaped, pressed, rolled, or extruded to create a customized heater that maximizes surface contact and may be, for example, in the form of a putty as shown in FIG. 3. With respect to FIG. 4, embodiments of the composite can be rolled like dough to the desired thickness or rolled between plates paired with a roller to the desired thickness. In embodiments utilizing rollers, plates, or molds, a releasing agent may be used on the rollers, plates, or molds to allow the composition to release freely without sticking, tearing, or deforming. The releasing agent may be applied in a film to the rollers, plates, or molds, such as high temperature fluorinated ethylene propylene films, or sprayed or otherwise applied to the surfaces. Embodiments of the dispersed CNT polymer composite 30 can be painted, spread, extruded, cast, or set in a mold when forming. This composite can be easily applied to many different substrates and is able to take the shape of the surface to be heated, including complex three-dimensional shapes, which is an improvement over commercial metal resistive heating wires for applications involving rough surfaces, and/or complex geometries. Additionally, the composite may be used to repair damaged electrical contacts or breaks in the material by reapplying much as one would patch a sidewalk, filling the cracks and voids then allowing the dispersed CNT composite 30 to cure in place. The polymer 34 component adds a support matrix for the CNT 32, and together the composite 30 of the polymer 34 with CNT 32 provide additional abrasion resistance, EMI shielding, waterproofing, and tensile strength enhancement to the surfaces to which they are applied.

As shown in FIGS. 1, 2, 4, 5, and 6, electrodes 20, 22, 42, 44, 56, 58 may be applied to the CNT joule heating element 10, 40, 50 at opposite ends to complete the electrical circuit of the resistive heating element. With respect to the dispersed CNT polymer composite joule heating element 40, this may be carried out before or after any amount of solvent has been removed. In an embodiment, a dispersed CNT polymer composite joule heating element 40 may be quickly spread on the surface to be heated and have electrodes 42, 44 applied at either end to form a complete, resistive heating circuit. The electrodes 20, 22, 42, 44, 56, 58 are fed power from an external power supply, which can be of a portable or stationary nature. The electrodes 20, 22, 42, 44, 56, 58 may comprise a conductive metal, such as copper, and be in the form of a mesh, tape, sheet, fiber, or deposition. The electrodes 20, 22, 42, 44, 56, 58 may also comprise a conductive carbon species such as carbon fiber veil, Buckypaper, graphene/CNT composites, CNT threads, conductive epoxies that may or may not contain conductive metals and carbon species, as well as depositions of any thereof. The electrodes 20, 22, 42, 44, 56, 58 may be attached through purely physical contact between the CNT heating element 10, 40, 50 and the electrode material. Additionally, the connection between the CNT heating element 10, 40, 50 and the electrode 20, 22, 42, 44, 56, 58 may be enhanced by heat, tin-based solders containing transition metals, such as chromium or nickel, gallium-based solders alloyed with indium, conductive epoxies, graphene, or graphene/CNT composites. Prior to joining, the CNT composite 30 may be wet by a volatile organic solvent, such as acetone or ethanol, to enhance effectiveness of the connection. Other suitable conductive solutions include graphene, a composite of CNTs and graphene in acetone, and conductive metal pastes such as silver.

Removing solvent from the dispersed CNT composite 30 increases electrical conductivity and solidifies the geometry of the dispersed CNT composite heater 40. The CNT polymer composite 30 may be cured by the use of heat, sealed with adhesives, or otherwise hardened to provide intimate contact between the heat source and the surface area to be heated. This heating may be done before or after allowing time for the dispersed CNT composite material to slowly dry, with or without additional vacuum. In an embodiment a final curing process involves attaching the electrodes 42, 44 and applying electric potential, between 1 V and 500 V to the composite 30. In embodiments, the applied potential is varied throughout the process and in other embodiments, the applied potential is not varied. In either of these embodiments the potential may be applied until conductivity stabilizes indicating successful purge of solvent. In an embodiment, the solvent may be removed using a curing process that includes of a combination of resistive and external heating to speed up the curing rate relative to heating by either of these methods alone. For example, the curing process may include applying electric current through the electrodes 42, 44 coupled to the composite 30 while applying an external thermal treatment (e.g., 50° C. to 300° C.) to quickly cure and remove the solvent. The thermal treatment may be provided by an external heat source such as, but not limited to, a hot plate, radiant heaters or lamps, high-density infrared treatment, drying ovens, or any combination thereof. The electric current may be applied while the composite 30 is at ambient pressure or in a vacuum. In an embodiment, electric potential, high or low, may be applied while the composite 30 is submerged under a liquid. The liquid may be a polar liquid, such as water or ethanol. In an embodiment applicable to thinner heaters, a rapid-curing process involving close proximity exposure to high temperature torches or radiant heating lamps may be used to remove solvent and reshape the polymer matrix component. This method can distort the surface and is preferably reserved for use when surface integrity is not of concern, such as when heater use is to be temporary or sacrificial, embedded into a carrier, or otherwise concealed from plain sight.

Embodiments of the dispersed CNT composite 30 curing process may be carried out in a controlled environment for an extended period of time. In an embodiment a slower rack unit ambient drying procedure is used for curing the dispersed CNT composite 30 that may or may not be vacuum and/or temperature assisted (−20° C. to 200° C.). For example, the material is rolled or extruded to desired thickness and then allowed to dry in ambient air of temperatures in the range of −20° C. to 100° C. for a period of 1 hour to 180 days. Electrodes 42, 44 may be applied at any time before, during, or after the drying process. Electrodes 42, 44 attached before drying may or may not have an electric potential applied concurrently with the slower drying process. Additional combinations of curing methods, such as electrical current and heat, may be used to finalize manufacture of the heating element.

The thickness of the CNT polymer composite joule heating element may vary and, for example, may be from 0.01 mm to 1,000 mm, or from 0.1 mm to 100 mm, or from 0.1 mm to 10 mm, or from 0.1 mm to 5 mm, or from 0.1 mm to 2 mm, or from 0.1 mm to 1 mm. The performance of the CNT composite heater 40 may vary based on the thickness of the joule heating element 40. For example, a 2.25 mm thick composite joule heating element 40, able to make contact with the same surface area as a 1 mm thick composite joule heating element 40, showed an increased average sheet resistance of 7.74 Ω/sq from 4.14 Ω/sq, a decreased average conductivity of 0.58 S/cm from 2.42 S/cm, and a decreased average power density of 1.21 W/cc from 5.9 W/cc while providing temperatures of 76° C.-115° C. compared to 120° C.-150° C. (see Example 4). A comparison between a commercial flexible resistive heater and a 1 mm thick dispersed CNT composite joule heating element with the same coverable surface area, 96.8 $cm^2$ (15 $in^2$) demonstrated that both heaters were operated to maintain an equivalent temperature range of 65° C.-85° C., and while only differing by less than 0.5 W in power consumption at approximately 14 W, the dispersed CNT composite heater was able do this from a significantly lower voltage of 13.5 V as compared to 50 V in the case of the commercial metal resistive wire heater.

In an embodiment, a dispersed CNT composite joule heating element 40, aligned thin film CNT joule heating element 10 or stitched CNT heating element 50, collectively referred to as the CNT heating element, may be enveloped between polymer films 24, 46 (such high-temperature polyamides like Kapton™, UV-curable polymers like urethane acrylate, or water based like polyurethane and water) to form a quick, flexible, and electrically insulated heater. In addition to the encapsulating polymers already listed, suitable encapsulating polymers also include rubber polymers like hydrogenated acrylonitrile butadiene rubber (HNBR), polyvinyl chlorine (PVC) polymers, polyimides, and fluoroelastomers. The encapsulating polymer film 24, 46 may be uniformly coated onto the CNT heating element. In embodiments, the encapsulating polymer film may have a thickness up to 1 mm on at least one side of the CNT heating element.

In embodiments, the encapsulating polymer film 24, 46 is cured, such as with exposure to ultraviolet light (UV curing). UV induced cure has many advantages over conventional cure in terms of less energy consumption and equipment space, reduced waste, less emission, higher productivity (fast cure) and lower temperature treatment. In addition, UV curable resins usually do not contain any organic solvents that have an adverse effect on the environment. The primary limitation of light-induced curing system is the limited light penetration depth which will depend on the wavelength and spectral distribution and usually does not exceed a few millimeters. This means that light induced cure is limited to inks, coatings and adhesives and in the case of adhesive applications. Since the encapsulating polymer film 24, 46 is within these range, UV cured thin polymer coating is quite suitable for protecting the heating element. Typical UV curable resins consist of oligomers, photo-polymerization initiator, coinitiators (spectral sensitizer, reducing agents etc.) and various additives such as stabilizers, antioxidants, plasticizers, and pigments.

In embodiments of the invention, UV curable systems are based on acrylate modified urethanes. Typical prepolymers of this class are made by reacting low molecular weight polyester or polyether diols with an excess of an aliphatic or aromatic diisocyanates. The remaining diisocyanate functionalities are then capped with a diacrylate monomer which results in acrylic functionalized monomers. Reactive diluents with one or more vinyl groups are often added to reduce the viscosity of the prepolymer. The prepolymers are then cross-linked in a free radical type polymerization by exposure to UV radiation. UV-curable acrylate urethane systems have good all-around performance properties on many substrates. They usually have good or excellent film hardness, elasticity and cure speed depending on the prepolymer used. Because of their superior durability and flexibility, they are often used as resilient floor coatings and as coatings for flexible packaging. Other applications include printing inks, paper and cardboard coatings.

In an embodiment, CNT heating element 10, 40, 50 may be integrated in a piece of clothing, such as a glove, jacket, or shoe insert. In embodiments utilizing the dispersed CNT composite joule heating element 40, the composite material 30 may be spread directly onto the fabric or made in advance affixed to an appropriate substrate and applied through process such as with a heat press or adhesives. Smaller modular heating circuits made from the CNT heating elements can be made on fabric pieces, which can then be inserted into clothes, cushions and furniture. The inserts may then replaceable and exchangeable. The heated clothing can be powered, for example, by rechargeable commercial batteries, portable communication device, or a laptop computer. Further applications for CNT heating elements include personal and cabin temperature regulation, precision heating of fluids and viscous solutions, food service and delivery preservation, air ships and high-altitude balloons, heating blankets and tarps for refugee and/or disaster relief camps, and warming medical bandages for injury treatment or disinfection.

In an embodiment the dispersed CNT composite 30 may serve as a carrier or housing matrix for additives intended to enhance performance and/or impart additional functionality. For example, materials with beneficial thermal capacities could serve as heat sinks and enable the polymer component 34 to hold more of the energy delivered to it by the CNT composite material 30 through joule heating. Examples of suitable materials are, but not limited to, ceramic powders, dry concrete or plaster, stone powders such as limestone, granite or soapstone, paraffin wax, grains, rice, and seeds such as flax seed. Additives may also enhance final material density, such as the use of baking soda to create carbon dioxide gasses to aerate the CNT composite 30.

In an embodiment, the dispersed CNT composite 30 may be embedded inside other carriers to enable heating capabilities to said carrier materials such as but not limited to concrete, porcelain, clay and ceramics, clothing and textiles, cord and rope, wood and composite flooring, baseboards, granite countertops and flooring, and stonework.

In an aspect of the present invention, a CNT joule heating element 40 may be functionalized before being integrated within a host material (e.g., a polymer) or being placed as a film on any targeted surface for heating. Functionalized CNTs demonstrate enhanced dispersion characteristics, which correlate to more uniform properties in the macro materials and devices. CNT polymer composites 34 also benefit from enhanced tensile strength resulting from the interactions between the hydroxyl functional groups and the matrix of polymer chains therein, serving as hooks to snare and grip the material. In an embodiment, functionalization may be accomplished using an atmospheric pressure plasma process that creates hydroxyl groups on the CNT surface thus making the material more hydrophilic. The latter quality can be tailored by the plasma power and exposure time that determines the level of functionalization applied. The atmospheric pressure plasma may be oxygen based atmospheric pressure plasma. The CNTs 32 may be exposed to the atmospheric pressure plasma for a time of from 0.1 s to 50 s, such as for 1 s. The CNTs may be exposed to the atmospheric pressure plasma at a power of from 5 W to 500 W, such as 100 W. The functionalization may include exposing the CNTs to oxidizing gaseous or liquid chemicals or mixtures thereof. Suitable oxidizing chemicals include peroxide, sulfuric acid, nitric acid, and hydrochloric acid.

In another embodiment, a stitched CNT heating element 50 is a made of a stitched fabric yarn 52. The CNT yarn 52 must be strong enough to allow for stitching with a device, such as a sewing machine. The CNT yarn 52 may be stitched onto a fabric at high density and connected to electrodes 56, 58, such as the electrodes described above with CNT composite and aligned CNT heating elements 10, 40. In an embodiment, the CNT yarn 52 is stitched at a density in a range from 100 to 10,000 stitches per square inch. Embodiments of the stitched CNT heating element 50 may increase the density of the stitched fabric up to 20% of the fabric weight without stitching, as expressed in grams per square inch. Stitching with CNT yarns 52 may also be used to electrically connect components in wearable electronics. In an exemplary embodiment, the CNT yarn 52 is a 4-ply CNT yarn, spun from 4 CNT arrays. An example of a suitable CNT yarn 52 is described in U.S. Pat. No. 9,796,121, the contents of which are incorporated herein in their entirety.

In order to facilitate a more complete understanding of the method of the invention, the following non-limiting examples are provided.

Example 1

Aligned Thin Film CNT Heater Fabrication. First, vertically aligned spinnable/drawable CNT arrays were synthesized. These carbon nanotubes were about 0.5 mm tall and were able to self-assemble into films without binders or additional chemicals. The synthesis process used thin film catalysts of iron and cobalt, which were sputtered on 4-inch silicon wafers that contained a 5 nm aluminum oxide buffer layer. The silicon wafers with catalyst were cut into 2 inch long pieces with variable widths—ranging up to 1.5 inch—that were loaded into a modified commercial CVD reactor, ET3000 from CVD Equipment Corporation. The growth process took place at a pressure of 740 Torr and temperature of 750° C. The main benefit of spinnable/drawable CNT arrays is that it allows the assembly of catalyst free and aligned CNTs into fibers, threads, films and sheets/ribbons. Typically, CNT ribbon drawing starts at one edge of the CNT array and continues until the array is consumed at the opposite edge. Approximately each linear millimeter of CNT array allows for a linear meter long CNT ribbon. CNT heaters were fabricated using CNT sheets of varying number of layers. The CNT heaters included sheets with 1, 2, 5, 10, 40, 70, 100, and 200 layers. These layers of aligned thin film CNT joule heating elements may be enveloped between two polymer films (e.g., high-temperature polyamides like Kapton™) to form an electrically insulated thin film heater.

Figure 8:
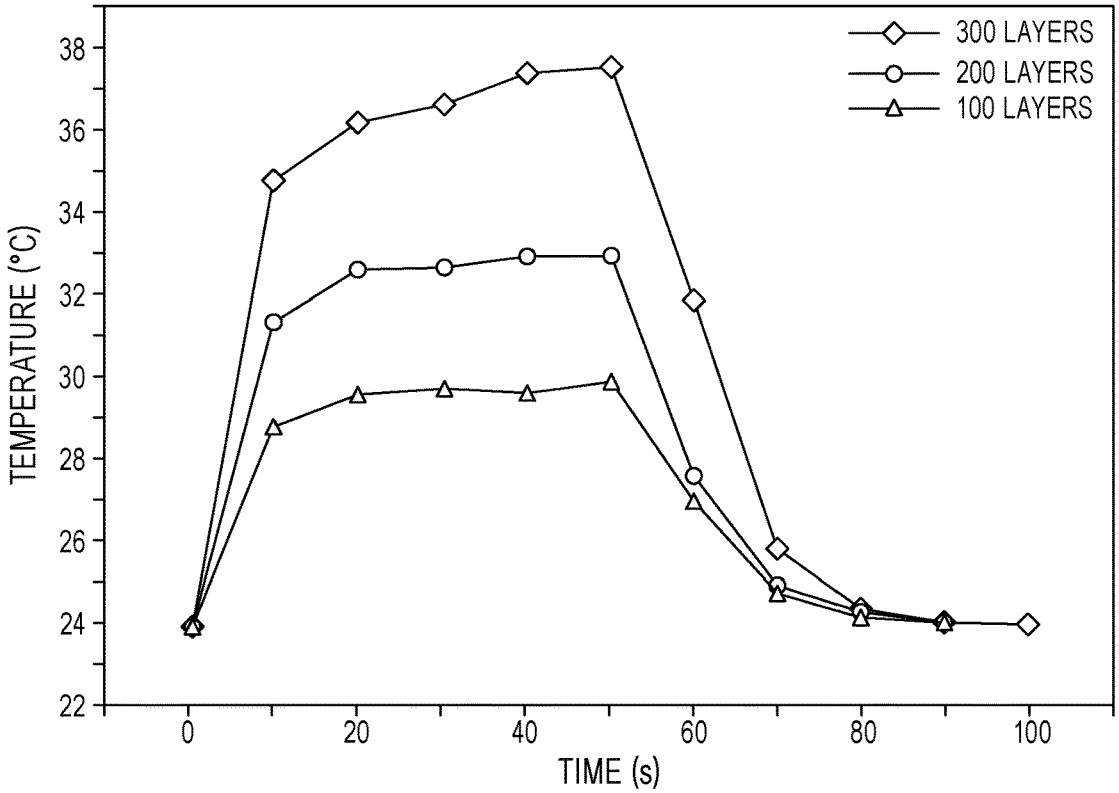
FIG. 8 is a graph of a heating profile as a function of time for multiple aligned CNT thin film heaters according to various embodiments of the present invention at 1.5 V.
Figure 9:
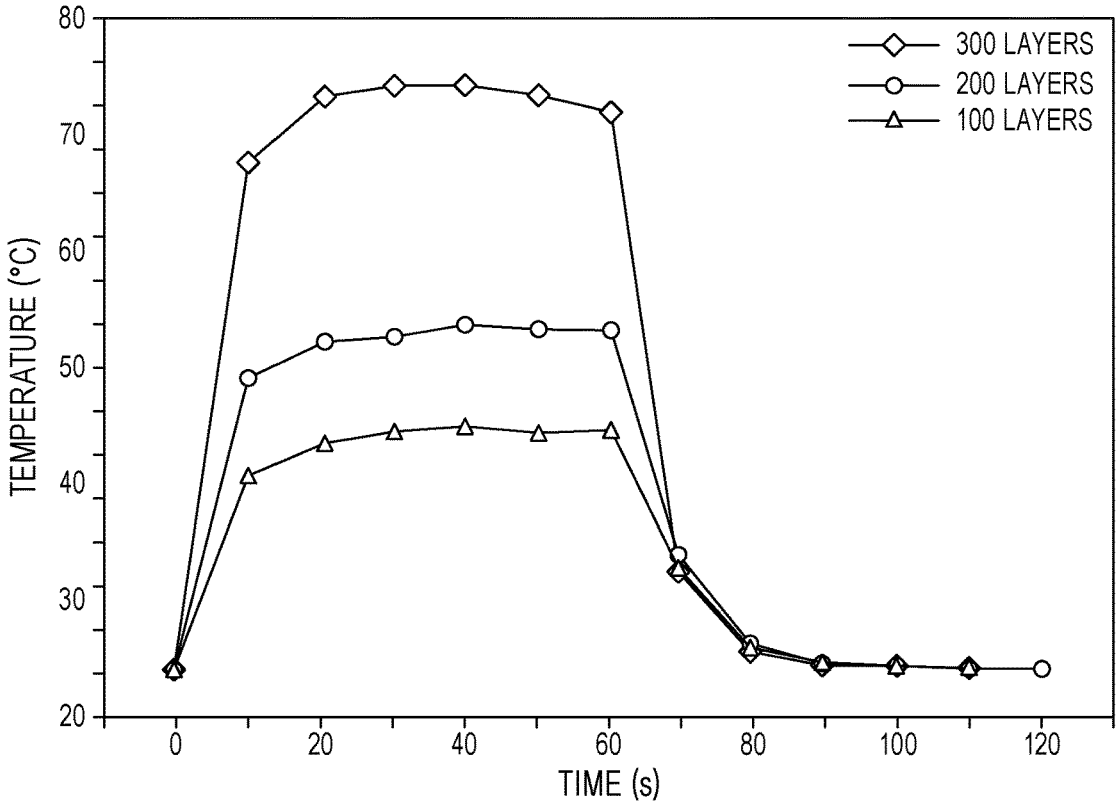
FIG. 9 is a graph of a heating profile as a function of time for multiple aligned CNT thin film heaters according to various embodiments of the present invention at 3 V.

Evaluation. Aligned CNT thin film heaters fabricated using different numbers of CNT layers were all sufficiently powered to reach up to 150° C. surface temperatures using less than 5 V of electric potential. FIGS. 8-10 show heating temperature curves of several aligned thin film heaters as a function of the consumed power with 1.5 V and 3.0 V applied respectively. Approximately less than 5 W of power was consumed to reach 150° C. in all cases.

Example 2

The heating profiles of aligned CNT thin film heaters fabricated from CNT sheets of 100, 200, and 300 layer thicknesses were evaluated at low voltages of 1.5 V and 3 V, and the results are shown in FIGS. 9 and 10, respectively. As shown, the number of layers can determine the electrical resistance of the aligned CNT sheets. The observed temperature evolution is divided into three stages: heating, saturation, and cooling. The latter appeared after the voltage source was turned off. During the saturation stage, the heat gained by the applied electric power was almost equal to the heat lost by radiation and convection. The average time for the heater to reach the temperature saturation was 20 sec. The average cooling time depended on the final temperature of the heater and therefore varied, as shown in FIGS. 9 and 10. This rapid heating time is a desirable parameter for applications such as deicing.

Example 3

Aligned CNT thin films were assembled within commercial white paint. A single coat of regular enamel paint was brushed onto a glass slide measuring 7.62×5.08 cm (3×2 in) and then 5 layers of CNT drawn from a spinnable array were laid in the same aligned orientation onto the paint. After allowing this to dry overnight, a second coat of paint was applied to cover the surface and again allowed to dry overnight. The white paint acts as a carrier material, which may then be used to hold the CNT film on the targeted heating surface. The integration of the CNT thin film was enhanced using an atmospheric pressure plasma process that created hydroxyl groups on the CNT surface thus making the material more hydrophilic. Copper electrodes were placed on opposite edges of the CNT material. Applying 20 V of electric potential drew 101 mA of current equating to 2.02 W and resulted in surface temperatures in the range of 44–53° C. Other materials may also serve as adequate carriers for aligned CNT thin film heaters, including but not limited to ceramics, powders, and polymers.

Example 4

Dispersed CNT Composite Heater Fabrication. The preparation method of the dispersed CNT composite putty shown in 4-6 is now described. Thermoplastic polyurethane (TPU), was dissolved in a non-volatile hygroscopic organic solvent, N-Methyl-2-pyrrolidone (NMP), with mixing and heating (50° C.-300° C.). CNTs were added to the TPU/NMP solvent solution under sonication and/or homogenization with similar heat (50° C.-300° C.) to increase the quality and degree of dispersion. Mixing times ranged from 5 seconds to 5 hours. The CNT-TPU-NMP slurry solution was immersed in a polar liquid, such as deionized water, which is miscible with the hygroscopic organic solvent but not the polymer nor the CNT. The solution underwent slight mixing, anywhere between 5 seconds and 1 hour, while the water solvated the original organic solvent and as a result separated said organic solvent from the CNT and polymer. The difference in solubility between solvent and composite components with the newly introduced polar liquid is used to drive the separation process and retrieve conformable CNT-polymer composite putty. The resulting precipitate was removed from the mixing container and squeezed to relieve of excess liquid. The fresh CNT composite putty ball was then rolled out to a thickness between 0.1 mm and 1 m and was allowed to dry until weight loss was no longer observed over time. After the excess water left the composite, additional drying time was needed for the subsequent out gassing of residual vapors. This CNT composite putty was then rolled, extruded, or formed into the intended shape and thickness for the heating application.

A final curing process involving applying electric current while an external thermal treatment was introduced (165° C.-195° C.) to flash-cure and remove all remaining solvent. Thermal cycling involving running heaters for extended periods of time at temperatures of 50° C.-200° C. helped improve the heating profile of the dispersed CNT composite surface.

Evaluation. A dispersed CNT composite joule heating element measuring 7.62×12.7 cm (3×5 in) was rolled to a thickness of 1 mm similar to the embodiment illustrated in FIG. 5. A second dispersed CNT composite joule heating element measuring 7.62×12.7 cm (3×5 in) was also prepared in an identical fashion to the heater in FIG. 5 but was rolled to a thickness of 2.25 mm. The dispersed CNT composite heaters were powered using a DC bench top power supply, but are also capable of operating on commercial batteries and USB outputs from portable electronics, laptops and personal computers. A fixed voltage was applied to the heaters and, as the CNT composite surface temperature increased, the electrical resistance decreased. The decreased electrical resistance increased the amount of current that could be drawn, thereby increasing the power consumption. This attribute is a driving force behind the CNT composite's ability to work as a responsive heater, allowing the material to rise significantly in surface temperature and conductivity concurrently. IR imaging of the 1 mm thick heater with 19.8 V applied, drew a current of 2.88 Amps, equating to 57 W while producing surface temperatures exceeding 130° C. At a constant 19.8 V the 1 mm thick joule heating element demonstrated an average sheet resistance of 4.14 Ω/sq, an average conductivity of 2.42 S/cm, and an average power density of 5.9 W/cc while providing temperatures of 120° C.-150° C. The 2.25 mm thick joule heating element, when a constant 19.8 V was applied, demonstrated a higher average resistivity at 7.75 Ω/sq, lower average conductivity of 0.58 S/cm, and therefore lower average power density of 1.40 W/cc while providing temperatures of 75° C.-110° C.

Example 5

A prepared electric circuit for a dispersed CNT composite heater that was fabricated on a cloth patch and used copper mesh to serve as electrodes. The dispersed CNT composite heater was embedded into the collar of a vest. IR imaging was conducted of the heating profile from the vest collar, inside which the heater was embedded. The electrodes were connected to a DC power supply set to 5 V and 610 mA were drawn, equating to 3.05 W, with resulting heating temperatures in the 45° C.-50° C. range.

Example 6

The heating profiles of a commercial flexible silicone-rubber resistive heater, purchased from McMaster-Caar (Item #35765K375), and a dispersed CNT composite heater with a thickness of 2.25 mm was made. A comparison of performance between the two heaters, each measuring 7.62× 12.7 cm (3×5 in) and able to cover an equal amount of surface area, demonstrated a similar requirement of approximately 14 W (+/−0.2 W) to generate temperature ranges of 65-85° C. The CNT heater however accomplished this on 13.5 V as opposed to 50 V needed for the commercial heater, a difference of 73%.

Example 7

An aligned thin film CNT joule heating element was enveloped in a water-based polyurethane film and assembled in an insole of a boot. The polyurethane adhered well to the CNT heating element. The enveloped CNT heating element was cured on flat glass in a fume hood under at room temperature.

Example 8

A conformable, low voltage, low mass CNT based joule-heating element was produced where the heater was made of stitched to fabric CNT yarn. CNT yarn was produced by spinning of single or multiple CNT arrays. For this example, a 4 ply CNT yarn, spun from 4 CNT arrays, was stitched on army fabric by using a sewing machine. The stitched yarn was interfaced with copper wires connected to it by silver paste. The fabricated this way fiber heater was powered and the generated temperature was measured using IR camera demonstrating that the stitched low mass CNT-based joule heating element was functional.

While specific embodiments have been described in considerable detail to illustrate the present invention, the description is not intended to restrict or in any way limit the scope of the appended claims to such detail. The various features discussed herein may be used alone or in any combination. Additional advantages and modifications will readily appear to those skilled in the art. The invention in its broader aspects is therefore not limited to the specific details, representative apparatus and methods and illustrative examples shown and described. Accordingly, departures may be made from such details without departing from the scope of the general inventive concept.

What is claimed is:

1. A method of making a low voltage joule heating element, conformable to its substrate, comprising:

forming said joule heating element from carbon nanotubes (CNTs);

wherein forming comprises dispersing the CNTs within a polymer solution to form a dispersed CNT polymer material, followed by curing the polymer solution;

wherein dispersing the CNTs within the polymer solution includes using a sonicator, a homogenizer, mechanical stirring, a magnetic stir bar, an external magnetic field, shaking, shearing, or any combination thereof; and wherein dispersing the CNTs with the polymer solution is carried out in the presence of externally applied heat in the range of 50-300° C.

2. The method of claim 1, wherein forming comprises drawing an aligned layer of the CNTs from a CNT array and stacking two or more aligned layers of the CNTs.

3. The method of claim 2, wherein the joule heating element comprises from 2 aligned layers to 1000 aligned layers.

4. The method of claim 1, further comprising:

controlling electrical properties of the joule heating element based on a thickness of the joule heating element.

5. The method of claim 2, further comprising:

controlling electrical properties of the joule heating element based on a number of the aligned layers.

6. The method of claim 2, further comprising:

encapsulating the aligned layers of the CNTs in an encapsulating film.

7. The method of claim 6, wherein the encapsulating film is selected from polymer films, ceramic films, adhesive films, layers of paint, or a combination thereof.

8. The method of claim 6, wherein the polymer film includes a polyurethane (TPU), a polystyrene, a polyvinyl chloride (PVC), a fluorinated polymer, a hydrogenated butadiene rubber, a polyethylene, a polystyrene, a polypropylene, a polytetrafluoroethylene, a polyimide, a polyamide and combinations thereof.

9. The method of claim 1, wherein the polymer solution includes a polymer dissolved in a non-volatile organic solvent that is soluble with both the polymer and the CNTs.

10. The method of claim 1, wherein externally applied heat is from a hot plate, radiant heaters, lamps, high-density infrared exposure, drying ovens or any combination thereof.

11. The method of claim 9, wherein the polymer is selected from a thermoplastic polyurethane (TPU) such as ethylene glycol and precursor of polyurethane (TPU), polystyrene, polyvinyl chloride (PVC), fluorinated polymers, hydrogenated butadiene rubber, polyethylene, polystyrene, polypropylene, polytetrafluoroethylene, polyimides and polyamides.

12. The method of claim 1, wherein forming comprises synthesizing the polymer solution component from a plurality of monomer precursors, of which at least one monomer contains dispersed CNTs.

13. The method of claim 9, further comprising:

adding a liquid, which is completely miscible with the non-volatile organic solvent yet immiscible to the CNT and polymer, to the dispersed CNT polymer solution to drive the separation of 40-90% of the original solvent content by mass from the CNT and polymer components, and resulting in a putty-like consistency that is viscous enough to be handled and shaped.

14. The method of claim 13 wherein the miscible liquid added is water.

15. The method of claim 1, wherein the CNTs are single-walled, double-walled, multi-walled character, or a combination thereof.

16. The method of claim 1, wherein at least one of a diameter, a length, a chirality, or a combination thereof of the CNTs varies.

17. The method of claim 1, wherein the CNTs are metallic, semiconducting, or a combination thereof.

18. The method of claim 1, further comprising:

shaping the dispersed CNT polymer composite material into a desired geometry for the joule heating element may be carried out by extrusion, rolling, pressing, molding or otherwise physically manipulating.

19. The method of claim 18, further comprising:

controlling an electrical conductivity of the joule heating element based on a thickness or an amount of the dispersed CNT polymer composite material.

20. The method of claim 1, further comprising:

controlling electrical properties of the joule heating element based on the weight percent CNT content of the joule heating element.

21. The method of claim 1, further comprising:

controlling electrical properties of the joule heating element based on the amount and degree of dispersion of the CNTs within the joule heating element.

22. The method of claim 13, further comprising:

removing the remaining solvent after shaping to solidify the joule heating element in the desired geometry.

23. The method of claim 22, wherein removing the solvent includes applying an external heat treatment from a hot plate, radiant heater, lamp, high-density infrared exposure, drying oven, freezer or any combination thereof.

24. The method of claim 1, further comprising:

installing electrical contacts to the joule heating element, the electrical contacts being configured to be coupled to an external power supply;

wherein the electrical contacts comprise a carbon material.

25. The method of claim 24, wherein the external power supply is stationary or portable.

26. The method of claim 24, wherein the external power supply is a source of renewable electricity generation.

27. The method of claim 24, wherein the electrical contacts comprise a metal material.

28. The method of claim 27, wherein the metal material is in the form of a film, a particle deposition, a wire, a sheet, or a mesh.

29. The method of claim 27, further comprising:

enhancing the connection of the electrical contacts to the joule heating element material using a solder, a low-melting metal alloy, a conductive epoxy, or a combination thereof.

30. The method of claim 29, wherein the solder comprises a tin-based solder containing a transition metal.

31. The method of claim 30, wherein the transition metal comprises chromium, nickel, or a combination thereof.

32. The method of claim 29, wherein the low-melting metal alloy comprises gallium alloyed with indium.

33. The method of claim 1, further comprising:

functionalizing the CNTs;

wherein functionalizing includes exposing the CNTs to atmospheric pressure plasma.

34. The method of claim 33, wherein functionalizing includes exposing the CNTs to an oxidizing chemical or mixtures thereof.

35. A method of making a low voltage joule heating element, conformable to its substrate, comprising:

forming said joule heating element from carbon nanotubes (CNTs);

the forming further comprising stitching a CNT thread to a fabric and installing a first electrode to a first end of the CNT thread and a second electrode at a second end of the CNT thread;

wherein the CNT thread is stitched to the fabric at a density to increase the weight of the stitched area of fabric by up to 20% g/cm$^2$, or at a density between 100 and 10,000 stitches per cm$^2$.

36. A low voltage joule heating element prepared by the process of claim 1.

37. An article including the low voltage heating element of claim 36.

38. A method of making a low voltage joule heating element, conformable to its substrate, comprising:

forming said joule heating element from carbon nanotubes (CNTs);

wherein forming comprises dispersing the CNTs within a polymer solution to form a dispersed CNT polymer material, followed by curing the polymer solution;

wherein the polymer solution includes a polymer dissolved in a non-volatile organic solvent that is soluble with both the polymer and the CNTs; and wherein the non-volatile organic solvent is selected from N-Methyl-2-pyrrolidone (NMP), acetone, an alcohol, tetrahydrofuran (THF), dichloromethane, and combinations thereof.

39. A method of making a low voltage joule heating element, conformable to its substrate, comprising:

forming said joule heating element from carbon nanotubes (CNTs);

wherein forming comprises dispersing the CNTs within a polymer solution to form a dispersed CNT polymer material, followed by curing the polymer solution;

wherein forming comprises synthesizing the polymer solution component from a plurality of monomer precursors, of which at least one monomer contains dispersed CNTs; and wherein the monomer containing dispersed CNTs is ethylene glycol.

40. A method of making a low voltage joule heating element, conformable to its substrate, comprising:

forming said joule heating element from carbon nanotubes (CNTs);

wherein forming comprises dispersing the CNTs within a polymer solution to form a dispersed CNT polymer material, followed by curing the polymer solution;

wherein the polymer solution includes a polymer dissolved in a non-volatile organic solvent that is soluble with both the polymer and the CNTs; and wherein the non-volatile organic solvent is selected from N-Methyl-2-pyrrolidone (NMP), acetone, an alcohol, tetrahydrofuran (THF), dichloromethane, and combinations thereof.

41. A method of making a low voltage joule heating element, conformable to its substrate, comprising:

forming said joule heating element from carbon nanotubes (CNTs);

adding a liquid, which is completely miscible with the non-volatile organic solvent yet immiscible to the CNT and polymer, to the dispersed CNT polymer solution to drive the separation of 40-90% of the original solvent content by mass from the CNT and polymer components, and resulting in a putty-like consistency that is viscous enough to be handled and shaped; and removing the remaining solvent after shaping to solidify the joule heating element in the desired geometry;

wherein forming comprises dispersing the CNTs within a polymer solution to form a dispersed CNT polymer material, followed by curing the polymer solution;

wherein the polymer solution includes a polymer dissolved in a non-volatile organic solvent that is soluble with both the polymer and the CNTs; and wherein removing the solvent includes passing an electric current through the mixture, supplied by an applied voltage from 1 V to 500 V.

42. The method of claim 41, wherein passing the electric current occurs at ambient pressure or in a vacuum.

43. The method of claim 41, wherein passing the electric current occurs while the dispersed CNT polymer composite material is submerged under a liquid.

44. The method of claim 43, wherein the liquid is a polar solvent.

45. The method of claim 44, wherein the liquid has a moderate to strong dielectric constant.

46. The method of claim 44, wherein the liquid is water.

47. A method of making a low voltage joule heating element, conformable to its substrate, comprising:

forming said joule heating element from carbon nanotubes (CNTs); and installing electrical contacts to the joule heating element, the electrical contacts being configured to be coupled to an external power supply;

wherein the electrical contacts comprise a carbon material; and wherein the carbon material is Bucky paper, a CNT/graphene composite solution, carbon fiber, carbon fiber veil, CNT thread, or wire.

48. A method of making a low voltage joule heating element, conformable to its substrate, comprising:

forming said joule heating element from carbon nanotubes (CNTs); and installing electrical contacts to the joule heating element, the electrical contacts being configured to be coupled to an external power supply;

wherein the electrical contacts comprise a carbon material; and wherein the electrical contacts comprise a conductive epoxy that contains metal, carbon-based conductive additives, or a combination thereof.

49. A method of making a low voltage joule heating element, conformable to its substrate, comprising:

forming said joule heating element from carbon nanotubes (CNTs); and installing electrical contacts to the joule heating element, the electrical contacts being configured to be coupled to an external power supply; and enhancing the connection of the electrical contacts to the joule heating element material using a solder, a low-melting metal alloy, a conductive epoxy, or a combination thereof;

wherein the electrical contacts comprise a carbon material;

wherein the electrical contacts comprise a metal material.

50. A method of making a low voltage joule heating element, conformable to its substrate, comprising:

forming said joule heating element from carbon nanotubes (CNTs); and installing electrical contacts to the joule heating element, the electrical contacts being configured to be coupled to an external power supply;

wherein the electrical contacts comprise a carbon material; and wherein the electrical contacts have a conductive solution applied thereon to increase the electrical conductivity of the connection between the joule heating element and the electrical contacts.

51. A method of making a low voltage joule heating element, conformable to its substrate, comprising:

forming said joule heating element from carbon nanotubes (CNTs); and shaping the dispersed CNT polymer composite material into a desired geometry for the joule heating element may be carried out by extrusion, rolling, pressing, molding or otherwise physically manipulating; and wetting a surface of the joule heating element with a solution to aid contact adhesion of the electrical contacts to the surface;

wherein forming comprises dispersing the CNTs within a polymer solution to form a dispersed CNT polymer material, followed by curing the polymer solution.

52. The method of claim 51 where the solution comprises acetone.

53. The method of claim 51 where the solution comprises a graphene or graphene/CNT composite.

54. A method of making a low voltage joule heating element, conformable to its substrate, comprising:

forming said joule heating element from carbon nanotubes (CNTs); and functionalizing the CNTs;

wherein functionalizing includes exposing the CNTs to atmospheric pressure plasma; and wherein the atmospheric pressure plasma comprises oxygen based atmospheric pressure plasma.

55. A method of making a low voltage joule heating element, conformable to its substrate, comprising:

forming said joule heating element from carbon nanotubes (CNTs); and functionalizing the CNTs;

wherein functionalizing includes exposing the CNTs to atmospheric pressure plasma; and wherein functionalizing includes exposing the CNTs to the atmospheric pressure plasma for a time of from 0.1 s to 50 s.

56. A method of making a low voltage joule heating element, conformable to its substrate, comprising:

forming said joule heating element from carbon nanotubes (CNTs); and functionalizing the CNTs;

wherein functionalizing includes exposing the CNTs to atmospheric pressure plasma; and wherein functionalizing includes exposing the CNTs to the atmospheric pressure plasma at a power of from 5 W to 500 W.

* * * * *